United States Patent [19]

Jenkins

[11] 4,439,960

[45] Apr. 3, 1984

[54] COMPOSITE INSULATION PANEL

[75] Inventor: Richard C. Jenkins, Overland Park, Kans.

[73] Assignee: Owens-Corning Fiberglas Corporation, Toledo, Ohio

[21] Appl. No.: 316,705

[22] Filed: Oct. 30, 1981

Related U.S. Application Data

[63] Continuation-in-part of Ser. No. 95,172, Nov. 19, 1979, abandoned.

[51] Int. Cl.[3] ..... E04B 1/00

[52] U.S. Cl. ..... 52/99; 52/511; 52/573; 52/781

[58] Field of Search ..... 52/573, 478, 770, 781, 52/547, 552, 235, 539, 508, 509, 511, 99

[56] References Cited

U.S. PATENT DOCUMENTS

| | | | |
|---|---|---|---|
| 2,282,293 | 5/1942 | Christenson | 52/573 X |
| 2,876,871 | 3/1959 | Coffman et al. | 52/508 |
| 3,045,293 | 7/1962 | Potchen | 52/573 X |
| 3,163,265 | 12/1964 | Waite | 52/573 X |
| 4,257,204 | 3/1981 | Rieger | 52/539 X |

*Primary Examiner*—Carl D. Friedman

*Attorney, Agent, or Firm*—Ronald C. Hudgens; Ted C. Gillespie; Paul J. Rose

[57] ABSTRACT

The insulation panel (26) includes a corrugated sheet (28) having a fibrous blanket of insulation (32) secured thereto and an end cap (41) secured to an upper portion of the corrugated sheet (28). The end cap (41) provides a means by which an upper portion of the panel (26) may be anchored to a vertical structural wall (11) to be insulated and a means by which a panel (26) in a next upper row may be supported. After installation, fastening means (43) between the end cap (41) and the corrugated sheet (28) is removed to allow the upper portion of the corrugated sheet (28) to float in the end cap (41) and compensate for thermal expansion and contraction. In another embodiment of the panel (26*a*), the fastening means (43*a*) between the end cap (41) and the corrugated sheet (28) is frangible and shears in two upon expansion and contraction of the corrugated sheet (28).

3 Claims, 8 Drawing Figures

COMPOSITE INSULATION PANEL

This is a continuation-in-part of application Ser. No. 95,172 filed Nov. 19, 1979, now abandoned.

TECHNICAL FIELD

This invention relates generally to insulation panels, and more particularly to insulation panels for the exterior of ductwork, precipitators, bag houses, hoppers, and other such structures commonly associated with coal-fire electric power generating plants.

BACKGROUND ART

Installation procedures with prior panels required a relatively large amount of assembly at the job site, and the completed installation had discrete areas with a relatively large heat loss.

DISCLOSURE OF INVENTION

An object of the invention is to provide a composite insulation panel having more assembly work done in the factory so that less assembly work is required at the job site for an installed panel system.

Another object is to provide reduced heat loss in completed installations of insulation panels.

In accordance with one embodiment of the invention, a composite insulation panel of the type having fibrous glass insulation secured to a corrugated metal sheet is provided, a generally Z-shaped flashing being secured to an upper edge portion of the corrugated sheet and an L-shaped fastening strip being secured to the Z-shaped flashing. Further, after installation, the fastening means between the Z-shaped flashing and the corrugated sheet is removed to allow the upper edge portion of the corrugated sheet to float during thermal expansion and contraction.

In another embodiment of the invention, the L-shaped fastening strip, instead of the Z-shaped flashing, is secured to the corrugated sheet, by frangible rivets which are readily shearable upon thermal expansion and contraction of the corrugated sheet after installation of the panels.

BEST MODE OF CARRYING OUT INVENTION

Figure 1:
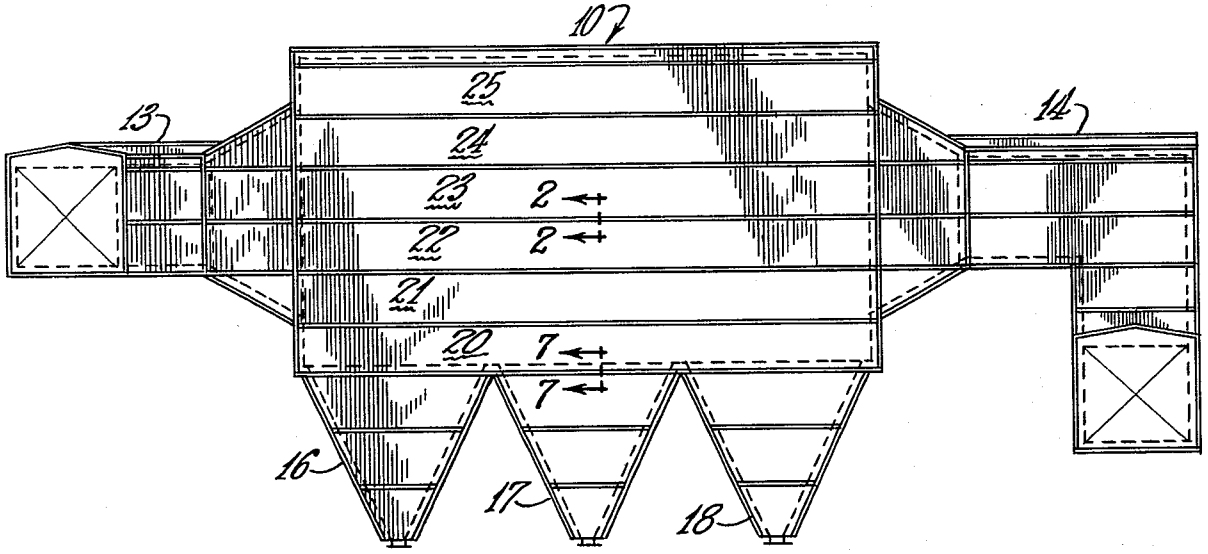
FIG. 1 is a side elevational view of a fly ash precipitator for a coal-fired electric power generating plant, with associated hoppers and ducts, the various vertical wall portions thereof having composite exterior insulation panels constructed and installed in accordance with the invention.

With respect to the drawings, as an example of the structures on which my improved insulation panel may be used, FIG. 1 shows a fly ash precipitator 10 for a coal-fired electric power generating plant. An inlet duct 13 connected to the precipitator 10 conveys exhaust combustion gases from the coal-fired steam-generating boilers of the plant and an outlet duct 14 conveys the cleaned gases away. Three rows 16, 17, and 18 of hoppers connected to the bottom of the precipitator 10 collect the fly ash removed from the combustion gases and discharge it into pipes (not shown) in which it is pneumatically conveyed away.

Figure 2:
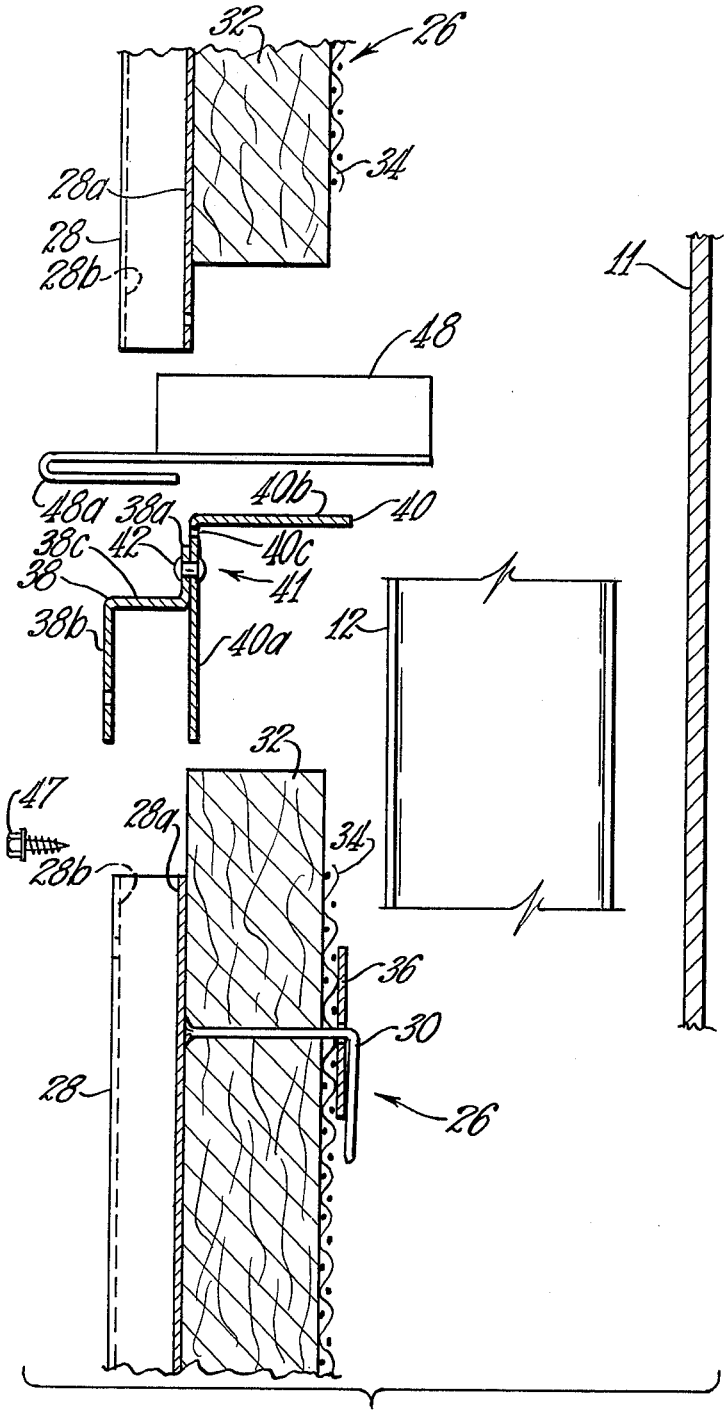
FIG. 2 is an exploded fragmentary sectional view taken generally along the line 2—2 of FIG. 1.
Figure 3:
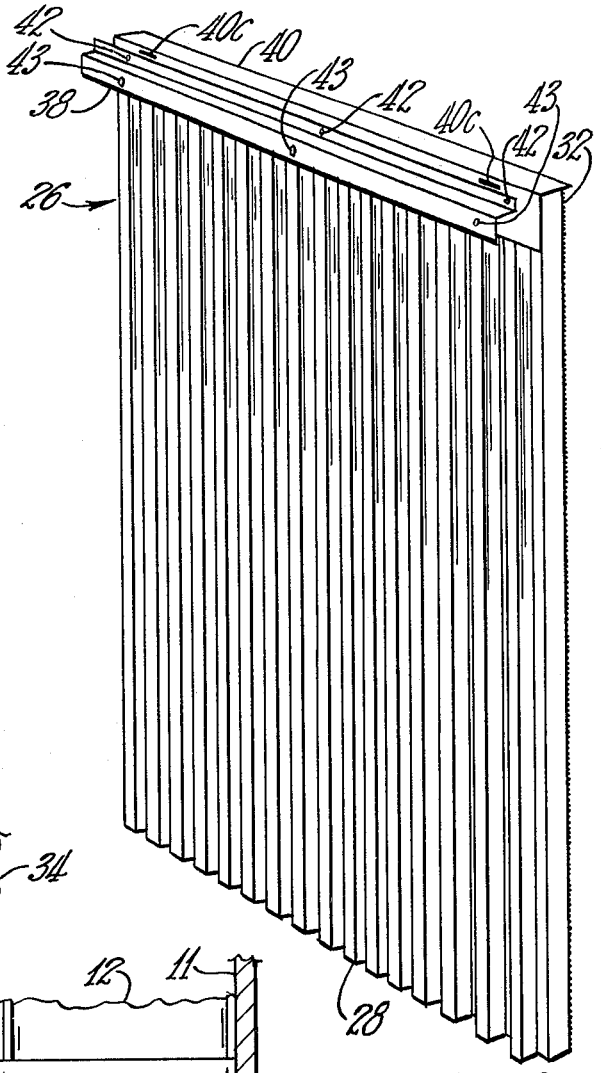
FIG. 3 is a perspective view of one embodiment of the composite insulation panels.

The precipitator 10, the ducts 13 and 14, and the hoppers in rows 16, 17, and 18 are insulated exteriorly to maintain the temperature of the gases therein above the dew point and thus prevent condensation of vapors and plugging-up of the equipment by the fly ash. The insulation includes six rows 20, 21, 22, 23, 24, and 25 of composite insulation panels constructed in accordance with the invention and installed on a side wall of the precipitator 10 as viewed in FIG. 1. One of the composite insulation panels, indicated by numeral 26, is best shown in FIG. 3 as one embodiment of the invention, portions of panels 26 also being shown in FIGS. 2, 4, and 7. The side wall of the precipitator 10 is indicated by numeral 11 in FIGS. 2 and 4.

Each composite insulation panel 26 includes a corrugated aluminum sheet 28 having a plurality of bendable pins 30 welded to the inner side thereof at inner web portions 28*a*. An insulating fibrous glass blanket 32 is impaled on the pins 30, and if desired, a sheet (not shown) of aluminum foil is impaled on the pins 30 over the fibrous glass blanket 32. Welded wire mesh 34 is installed on the pins 30 over the blanket 32. Retaining clips 36 are pressed respectively on the pins 30 and the free end portions of the pins are bent over through an angle of about ninety degrees. The upper portion of the blanket 32 projects upwardly beyond the corrugated sheet 28.

In accordance with one embodiment of the invention, as part of the manufacturing process in the factory, a generally Z-shaped flashing 38 is fastened to an L-shaped fastening strip 40, and the Z-shaped flashing 38 is fastened to the outer side of the upper portion of the corrugated sheet 28. As shown, an upper leg portion 38*a* of the Z-shaped flashing is secured by three rivets 42 to a normally vertical leg portion 40*a* of the L-shaped fastening strip, and a lower leg portion 38*b* of the Z-shaped flashing is secured by the three rivets 43 to outer web portions 28*b* of the corrugated sheet 28. The Z-shaped flashing 38 and the L-shaped fastening strip 40 together form an upper cap 41 of the panel 26. When the panel 26 is in use, the upper cap 41 provides a means by which the upper portion of the panel can be anchored to the side wall 11 and also forms a support for the next upper panel.

The walls of structures which can be insulated by my improved insulation panels are generally provided with spaced stiffening ribs on the outer side. The side wall 11 of the precipitator 10 has a plurality of such stiffening ribs, one such rib 12 being shown in FIGS. 2 and 4. The ribs 12 may be I-beams or structural channels welded to the side wall 11.

Installation of the panels 26 on the side wall 11 starts with the lowest row 20 (FIG. 1). A row of generally J-shaped channels 44 (FIG. 7) is welded all the way across the bottom portion of the side wall 11 either to the ribs 12 or to separate supports (not shown). The channels 44 are then stuffed with fibrous glass insulation 45. Bottom flashings 46 are then secured to the channels 44 by self-drilling screws 47, the lower portions of insulation panels 26 being secured at the same time. The bottom flashings 46 are over twice as long as the width of a panel 26. Opposite end portions of a bottom flashing 46 are accurately located and temporarily firmly clamped to the row of channels 44. A pair of panels 26, with vertical edge portions of their corrugated sheets 28 overlapping, are then placed in position on the clamped bottom flashing 46. Alternate ones of the inner web portions 28*a* are then secured by the screws 47, which also secure the bottom flashing 46 in place and allow the temporary clamps to be removed.

After each panel 26 in the row 20 is thus secured at its lower portion, its upper portion is secured with respect to the side wall 11. In the embodiment shown, standoff brackets 48 (FIGS. 2 and 4) are provided for this purpose. Each bracket 48 is a piece of angle iron having one leg portion longer than the other in the longitudinal direction of the angle iron, the longer leg portion being reversely outwardly bent to provide a generally U-shaped hook portion 48*a*. Each vertical leg portion 40*a* of the L-shaped fastening strip 40 on the upper portion of a panel 26 is provided with a pair of slots 40*c* respectively adjacent opposite vertical edges of the panel and closely adjacent the respective horizontal leg portion 40*b*. The upper portion of a panel 26 is secured by hooking a pair of the brackets 48 through the slots 40*c*, welding the brackets to the horizontal leg portion 40*b*, and welding the other ends of the brackets to the side wall 11.

After the row 20 of panels 26 is in place, the panels of the row 21 are installed by placing the lower portions of their corrugated sheets 28 on horizontal body portions 38*c* of the Z-shaped flashings 38 of the panels 26 of the row 20, securing alternate ones of the inner web portions 28*a* by self-drilling screws 47 to the upper leg portions 38*a* and the vertical leg portions 40*a* respectively of the Z-shaped flashings 38 and the L-shaped fastening strips 40 of the panels 26 of the row 20, and fastening the upper portions of the panels by hooking standoff brackets 48 through the slots 40*c* and welding them to the side wall 11.

The panels 26 of the rows 22, 23, 24, and 25 are similarly installed, each row of panels 26 being installed right on top of the one below. This simple installation should be compared to the elaborate installation of the prior art as explained hereinafter. After a panel 26 is installed, the rivets 43 in this embodiment of the invention are drilled out to allow floating of the upper portion of the corrugated sheet 28 between the lower leg portion 38*b* and the vertical leg portion 40*a*. An expansion-contraction joint is thus provided.

Figure 5:
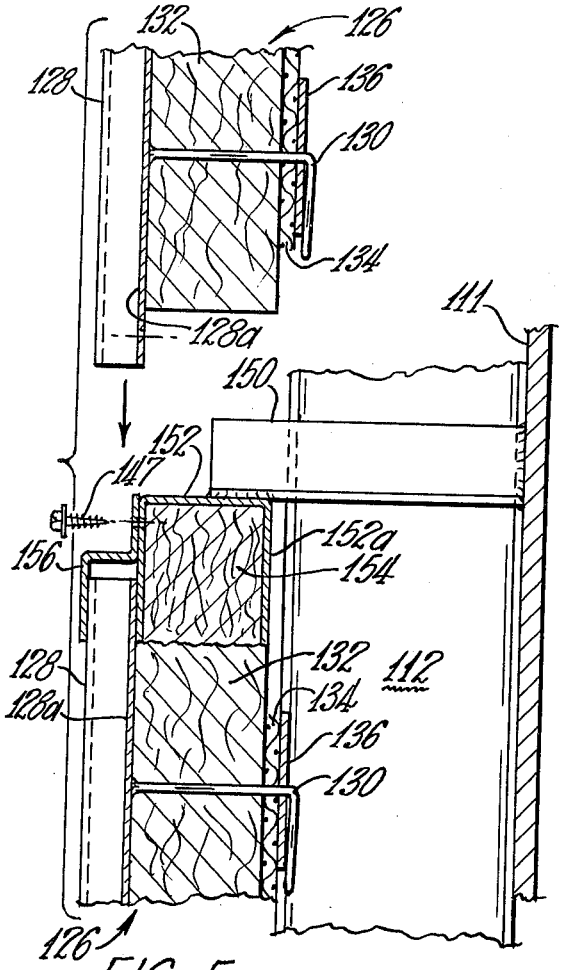
FIG. 5 (PRIOR ART)
FIG. 5 is a view similar to FIG. 4, but showing a prior panel and installed panel system.
Figure 6:
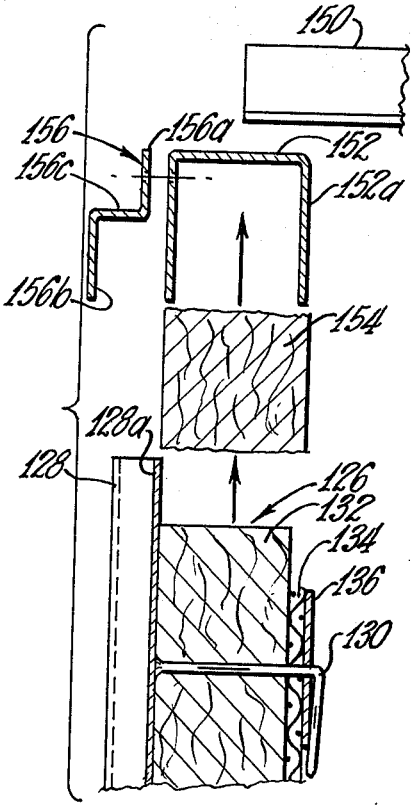
FIG. 6 (PRIOR ART)
FIG. 6 is an exploded fragmentary sectional view of portions of FIG. 5.

The prior panels and method of installation are illustrated in FIGS. 5 and 6, wherein a vertical wall portion 111 with stiffening ribs 112 represents a part of any industrial gas handling equipment which must be insulated, and insulation panels 126 represent the prior panels. Each panel 126 includes a corrugated aluminum sheet 128 having a plurality of bendable pins 130 welded to the inner side thereof at inner web portions 128*a*. An insulating fibrous glass blanket 132 is impaled on the pins 130. Welded wire mesh 134 is installed on the pins 130 over the blanket 132. Retaining clips 136 are pressed respectively on the pins 130 and the free end portions of the pins are bent over through an angle of about ninety degrees. The upper portion of the corrugated sheet 128 projects upwardly beyond the blanket 132.

Figure 7:
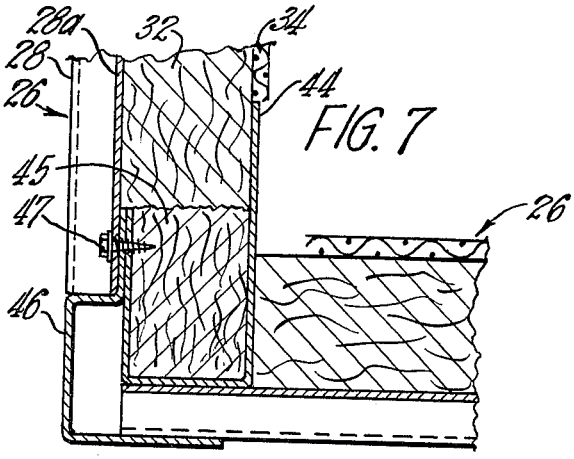
FIG. 7 is a fragmentary sectional view taken generally along the line 7—7 of FIG. 1.

Assuming that a number of rows of panels 126 are to be installed by the prior method over the wall portion 111 and its stiffening ribs 112, the lowest row is installed first, and the first step of this prior method is the installation of J-shaped channels such as the channels 44, and the stuffing thereof with fibrous glass insulation such as the insulation 45 (FIG. 7). Next, a plurality of rows of generally equally spaced angle iron standoff brackets 150 are welded to the wall portion 111 at predetermined heights, with equal distances between rows. The brackets 150 must be located accurately as to their height. Then a plurality of rows of inverted channels 152 are welded to the brackets 150, having been positioned as accurately as possible in an attempt to locate the longitudinal axes of all the channels in a common plane. The channels 152 are then stuffed with strips of fibrous glass insulation 154.

After all this field preparation, the panels 126 may be installed. Those in the lowest row are secured at their lower portions, along with the bottom flashings such as the bottom flashings 46, as previously described with respect to the panels 26. The upper portions of the panels 126 of the lowest row are not rigidly secured, but are retained by generally Z-shaped flashings 156, each of which is over twice as long as the width of a panel 126. The upper leg portion 156*a* of a flashing 156 is temporarily firmly clamped at opposite ends of the flashing to the channel of channels 152, with a lower leg portion 156*b* overlapping the upper portions of respective panels 126, and the lower portions of corrugated sheets 128 of panels 126 of the next higher row are located on the body portion 156*c* of the flashing. Then self drilling screws 147 are applied at alternate inner web portions 128*a*, securing both the lower portions of the panels 126 of the next higher row and the Z-shaped flashing 156 to the channel 152 and retaining the upper portions of the panels 126 of the lowest row. The temporary clamps (not shown) for the Z-shaped flashing 156 are then removed.

The above process is repeated for the remainder of the lowest row and then for successively higher rows.

The channels 152 have a sidewall portion 152*a* exposed to heated air between the panels 126 and the wall portion 111. The equivalent of the sidewall portion 152*a* has been eliminated in my improved construction having the L-shaped fastening strip 40. This results in less heat loss in the vicinity of the Z-shaped flashings 38.

Also, with my improved construction, the requirement of accurately locating the standoff brackets 150 and the channels 152 is eliminated. Further, the separate hauling of channels 152, insulation 154, and Z-shaped flashings 156 to the job site and up to their point of use is eliminated. In addition, the temporary clamping and unclamping of the Z-shaped flashings 156 and the stuffing of the insulation 154 into the channels 152 are eliminated.

Figure 4:
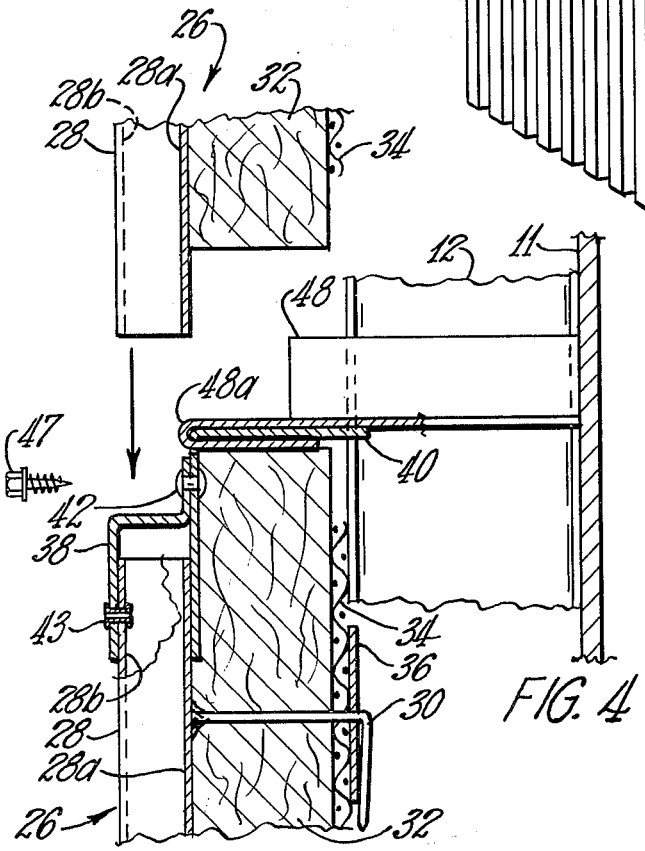
FIG. 4 is a partially exploded fragmentary sectional view similar to FIG. 2, but with more of the various parts assembled.
Figure 8:
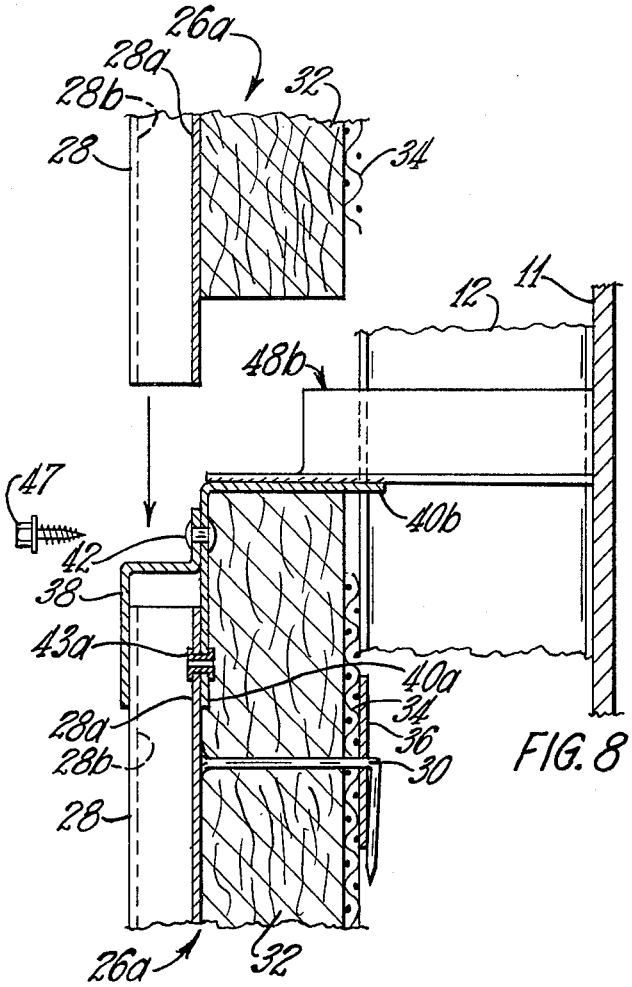
FIG. 8 is a view similar to FIG. 4, but illustrating another embodiment of the invention.

In another embodiment of the invention shown in FIG. 8, the corrugated aluminum sheet 28 of a panel 26*a* is secured to a lower portion of the vertical leg portion 40*a* of the L-shaped fastening strip 40 by three frangible rivets 43*a* extending through respective inner web portions 28*a* of the corrugated sheet, instead of being secured to the Z-shaped flashing 38 by rivets 43 extending through the outer web portions 28*b* as in the embodiment of FIG. 4. In this embodiment, the slots 40*c*

(FIGS. 2 and 3) and the hook portions 48*a* (FIGS. 2 and 4) are eliminated, the horizontal leg portion 40*b* of the fastening strip 40 only being welded to a pair of brackets 48*b*. After installation of a panel 26*a*, expansion and contraction of the corrugated sheet 28 causes shearing of the frangible rivets 43*a* and accommodates such thermal expansion and contraction without buckling of the corrugated sheet.

Various other modifications may be made in the structure shown and described without departing from the spirit and scope of the invention.

I claim:

1. A prefabricated composite insulation panel useful in a plurality to cover the exterior of ductwork, precipitators, baghouses, hoppers, and other such components of coal-fired electric power generating plants, the panel comprising a generally rectangular corrugated sheet having a blanket of fibrous glass insulation secured thereto in engagement with inner corrugation extremities thereof, the blanket projecting upwardly beyond a normally upper edge of the corrugated sheet, an upper cap mounted on said corrugated sheet and including a generally Z-shaped flashing and an L-shaped fastening strip, the L-shaped fastening strip having a normally horizontal leg portion adjacent an upper edge of the blanket and a normally vertical leg portion extending downwardly from the horizontal leg portion on an outer side of the blanket and extending below the upper edge of the corrugated sheet into engagement with the inner corrugation extremities thereof, the generally Z-shaped flashing having a normally vertical inner upper leg portion secured to an upper portion of the vertical leg portion of the L-shaped fastening strip above the upper edge of the corrugated sheet, a normally horizontal body portion covering but spaced from the upper edge of the corrugated sheet, and a normally vertical outer lower leg portion extending downwardly from the horizontal body portion and below the upper edge of the corrugated sheet into engagement with outer corrugation extremities thereof, and a plurality of frangible temporary fasteners each extending through a lower portion of the vertical leg portion of the L-shaped fastening strip and through an upper portion of a respective one of the inner corrugation extremities of the corrugated sheet, the fasteners having sufficiently high shear and tensile strengths to fixedly secure the L-shaped fastening strip and the upper portion of the corrugated sheet to each other during normal handling of the panel before installation, yet having sufficiently low shear strength to fail by sheating due to thermal expansion of the corrugated sheet after installation of the panel in a manner fixedly securing the L-shaped fastening strip and the lower end portion of the corrugated sheet with respect to each other.

2. A panel as claimed in claim 1 wherein the frangible fasteners are a plurality of normally horizontally spaced rivets.

3. A panel as claimed in claim 2 wherein the rivets are hollow.

* * * * *